US012017735B1

(12) United States Patent
Singh

(10) Patent No.: US 12,017,735 B1
(45) Date of Patent: Jun. 25, 2024

(54) THERMAL MARINE PROPULSION SYSTEM

(71) Applicant: Shantanu Singh, Ghaziabad (IN)

(72) Inventor: Shantanu Singh, Ghaziabad (IN)

( * ) Notice: Subject to any disclaimer, the term of this patent is extended or adjusted under 35 U.S.C. 154(b) by 0 days.

(21) Appl. No.: 18/607,925

(22) Filed: Mar. 18, 2024

(30) Foreign Application Priority Data

Mar. 7, 2024 (IN) ..... 202411016127

(51) Int. Cl.
*B63B 1/32* (2006.01)
*B63H 11/12* (2006.01)

(52) U.S. Cl.
CPC ..... *B63B 1/32* (2013.01)

(58) Field of Classification Search
CPC ..... B63B 1/32; B63H 11/12
See application file for complete search history.

(56) References Cited

U.S. PATENT DOCUMENTS 1,787,844 A * 1/1931 Widdis ..... B63H 11/12 60/227
2,546,210 A * 3/1951 Bittner ..... B63H 21/36 251/126
2024/0034445 A1 2/2024 Singh

FOREIGN PATENT DOCUMENTS

CN 109159880 A * 1/2019 ..... B63H 11/12

* cited by examiner

*Primary Examiner* — Stephen P Avila
(74) *Attorney, Agent, or Firm* — Workman Nydegger

(57) ABSTRACT

A thermal marine propulsion system is disclosed as an alternative to ordinary marine propulsion systems that utilize mechanical thrusters, i.e. propellers or impellers. The invented system utilizes a solid-state approach and employs a plate-type electric heating-element with a heat-emitting surface, which through boiling and displacing the surrounding water, creates a pressure difference between itself and the opposite-surface. Consequently, a thrust is generated along the (inward-pointing) normal-vector of the heat-emitting surface.

2 Claims, 11 Drawing Sheets

THERMAL MARINE PROPULSION SYSTEM

CROSS-REFERENCE TO RELATED APPLICATIONS

The present application claims the benefit of foreign priority to copending Indian non-provisional Patent application Ser. no. 202411016127, filed on Mar. 7, 2024, and entitled "THERMAL MARINE PROPULSION SYSTEM", the entire contents of which are incorporated herein by reference in their entirety for all purposes.

BACKGROUND OF THE INVENTION

Field of the Invention

The invention generally relates to marine propulsion systems and, more particularly, but not exclusively, to solid-state marine-thrusters.

Description of the Related Art Including Information Disclosed Under 37 CFR 1.97 and 37 CFR 1.98

Typically, watercrafts propel by the thrust generated by mechanical thrusters consisting of an electric motor or an internal combustion engine driving a propeller, or less frequently, in pump-jets, an impeller.

The mechanical systems are bulky, expensive, inefficient and unreliable. Moreover, the drag experienced by the watercraft while cruising through the surrounding water limits its maximum-speed, maneuverability and fuel-efficiency.

Besides, another thermal marine-thruster for a marine propulsion system is disclosed in U.S. patent application Ser. No. 18/376,748 to Shantanu Singh, and published as US-2024-0034445-A1. The marine-thruster of the present invention is distinct from that disclosed in the prior art in terms of the requisite materials, structure and construction, and also in the sense that the respective thrusts are generated in opposite directions by virtue of different respective underlying operating mechanisms.

OBJECT OF THE INVENTION

The object of the present invention is to overcome the limitations associated with traditional marine propulsion systems. The invention aims to provide a more compact, economical, efficient and reliable solution by addressing the drawbacks of bulky, inefficient, unreliable and expensive mechanical thrusters. Furthermore, the invention aims to reduce drag between a watercraft and the surrounding water, thereby enhancing maximum-speed, maneuverability, and fuel-efficiency. The invention introduces a marine-thruster that optimizes design simplicity and performance, thereby ensuring a smoother, reliable and economical solution for marine propulsion.

SUMMARY OF THE INVENTION

Accordingly, it is the general purpose and primary object of the present invention to provide a solid-state thermal marine-thruster for a marine propulsion system. The thruster comprises a plate-type electric heating-element coupled to a power-supply through electrical-wiring and having a heat-emitting surface (i.e., a hot-side) so as to boil the surrounding water when submerged. The resultant expanding steam-filled region surrounding the hot-side develops a higher-pressure than that of the water surrounding the opposite outer-surface of the heating-element. Simply, operating the thruster in a submerged situation generates a pressure-difference between its opposite-faces, which is effectively a thrust.

Moreover, the solid-state thermal marine-thruster is more compact, economical, efficient and reliable than its mechanical counterparts; the steam-filled region offers lesser drag than water, hence increasing maximum-speed, maneuverability and fuel-efficiency of the watercraft; and the turbulence inside the steam-filled region has a self-cleaning effect on the thruster.

BRIEF DESCRIPTION OF THE DRAWINGS

The invention is described with reference to the accompanying drawings, wherein.

DETAILED DESCRIPTION OF THE INVENTION

The marine propulsion system of the present invention comprises a solid-state thermal marine-thruster in the form of an electric heating-element, structurally plate-type, with a heat-emitting surface (i.e., a hot-side) formed of an electrically-insulative and thermally-conductive layer made from, but not limited to, beryllium oxide, aluminum nitride, or combinations of these, and an opposite-surface formed of an electrically and thermally insulative layer made from, but not limited to, ceramic, wherein both the layers are mechanically attached to the heating-element, each layer covering the respective surface entirely.

Figure 1:
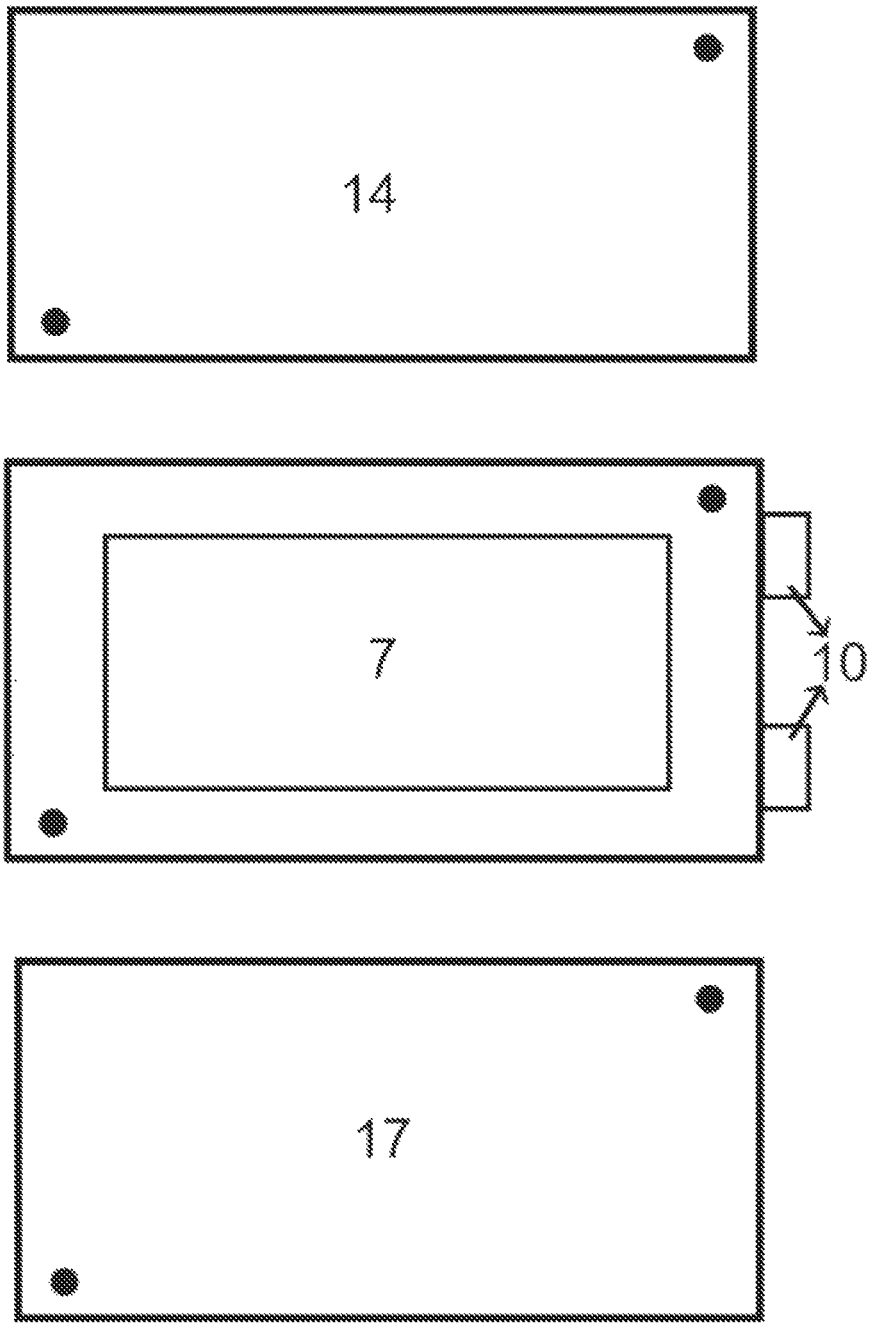
FIG. 1 is a schematic front orthographic view showing an illustrative and non-exclusive example of primary components of a solid-state thermal marine-thruster for a marine propulsion system according to the present invention.

Referring to FIG. 1, a schematic front orthographic view showing an illustrative and non-exclusive example of primary components of a solid-state thermal marine-thruster for a marine propulsion system according to the present invention is shown, which includes an electric heating-element 7, a pair of external-terminals 10 of the heating-element 7, an electrically-insulative and thermally-conductive layer 14, and an electrically and thermally insulative layer 17. Note that the black circles at the corners of the heating-element and both the layers represent holes punched for riveting. Furthermore, intricate details of the thruster are illustrated in subsequent figures for the sake of clarity and brevity.

Figure 1A:
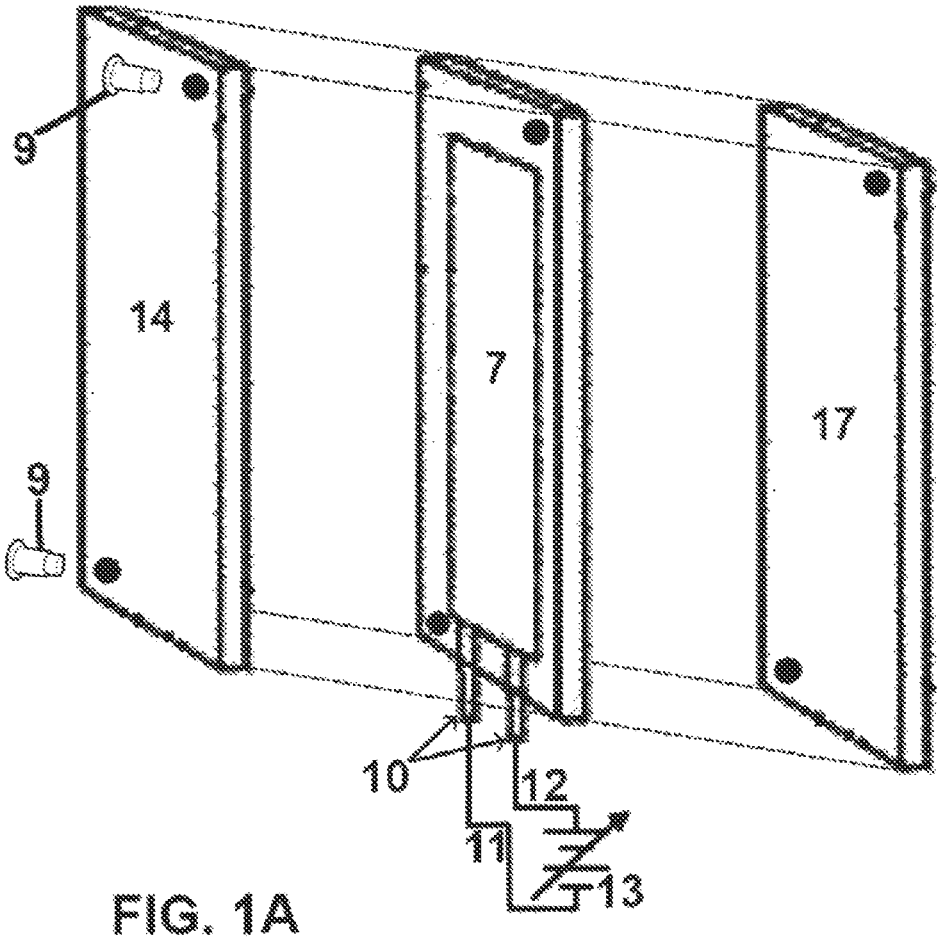
FIG. 1A is a supplementary schematic side perspective exploded view illustration of the thermal marine-thruster of FIG. 1.

FIG. 1A is a supplementary schematic side perspective exploded view illustration of the thermal marine-thruster of FIG. 1, which includes the electric heating-element 7, the pair of external-terminals 10 of the heating-element 7, the electrically-insulative and thermally-conductive layer 14, the electrically and thermally insulative layer 17, a pair of rivets 9, a power-supply 13, and a pair of electrical-wires 11 and 12, wherein the pair of external-terminals 10 of the heating-element 7 are connected to the power-supply 13 via the pair of electrical-wires 11 and 12.

Figure 1B:
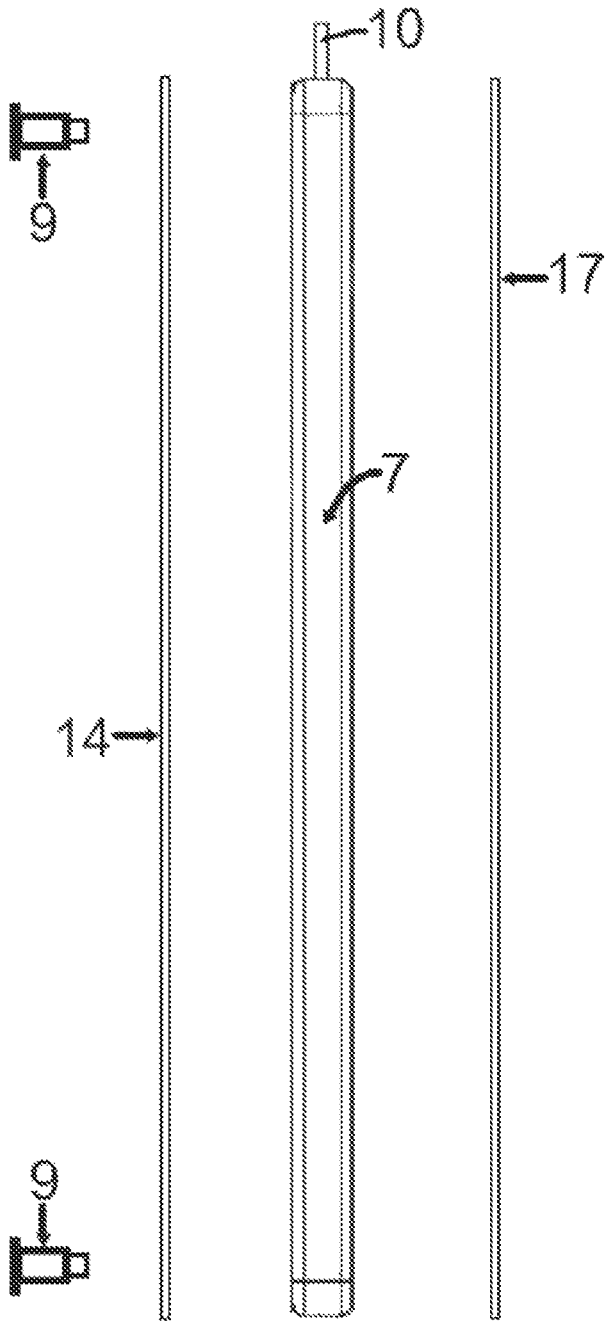
FIG. 1B is a supplementary schematic side orthographic exploded view illustration of the thermal marine-thruster of FIG. 1.

FIG. 1B is a supplementary schematic side orthographic exploded view illustration of the thermal marine-thruster of FIG. 1, which includes the electric heating-element 7, the pair of external-terminals 10 of the heating-element 7, the electrically-insulative and thermally-conductive layer 14, the electrically and thermally insulative layer 17, and the pair of rivets 9. Note that the electrical connection between the pair of external-terminals 10 and the power supply 13 can not be clearly shown because one of the external-terminals is hidden from view behind another.

Figure 1C:
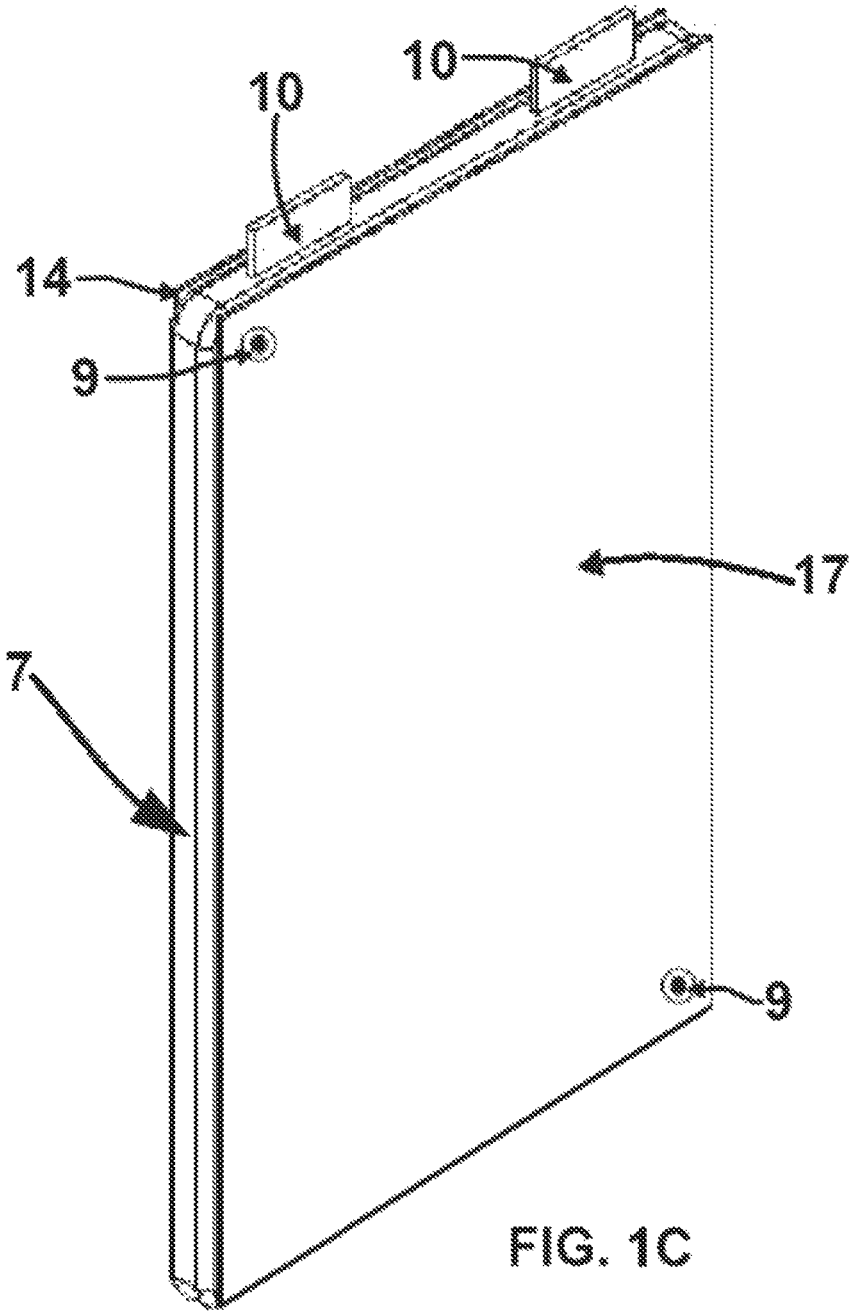
FIG. 1C is a supplementary schematic top isometric view illustration of the thermal marine-thruster of FIG. 1.

FIG. 1C is a supplementary schematic top isometric view illustration of the thermal marine-thruster of FIG. 1, wherein the electric heating-element 7, the electrically-insulative and thermally-conductive layer 14, and the electrically and thermally insulative layer 17 are joined together by the pair of rivets 9, and wherein the pair of external-terminals of the heating-element 7 are indicated by 10.

Figure 1D:
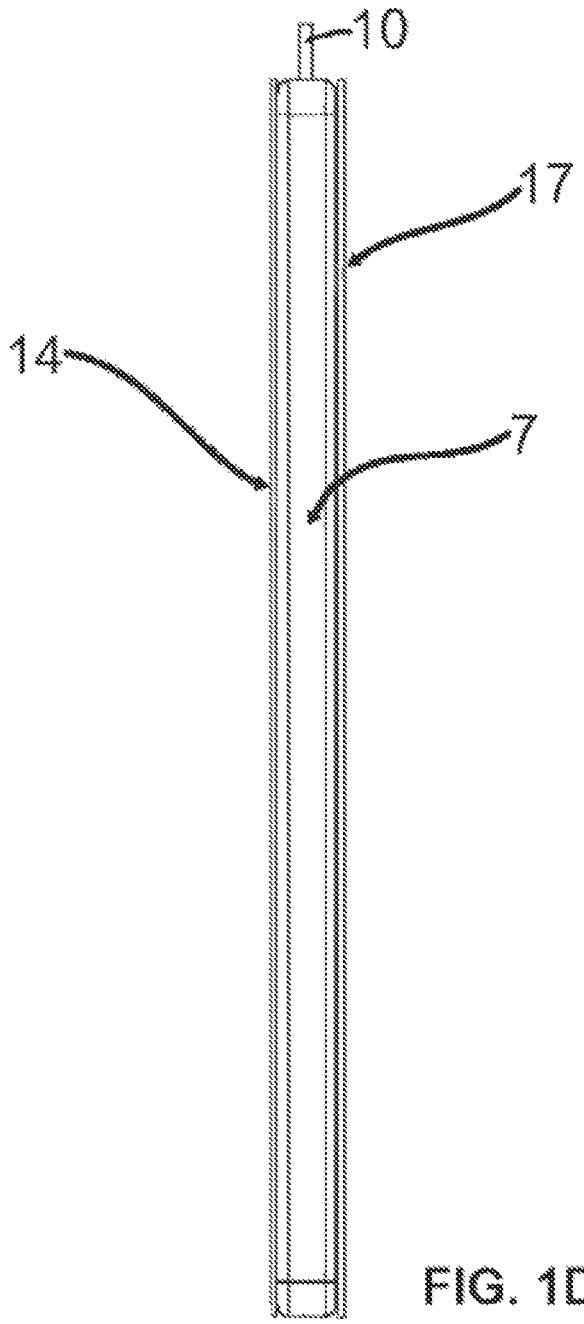
FIG. 1D is a supplementary schematic side orthographic view illustration of the thermal marine-thruster of FIG. 1.

FIG. 1D is a supplementary schematic side orthographic view illustration of the thermal marine-thruster of FIG. 1, wherein the electric heating-element 7, the electrically-insulative and thermally-conductive layer 14, and the electrically and thermally insulative layer 17 are joined together by the pair of rivets 9, and wherein the pair of external-terminals of the heating-element 7 are indicated by 10. Note that one of the external-terminals is hidden from view behind another, and the pair of rivets 9 are also hidden from view in the figure.

Figure 1E:
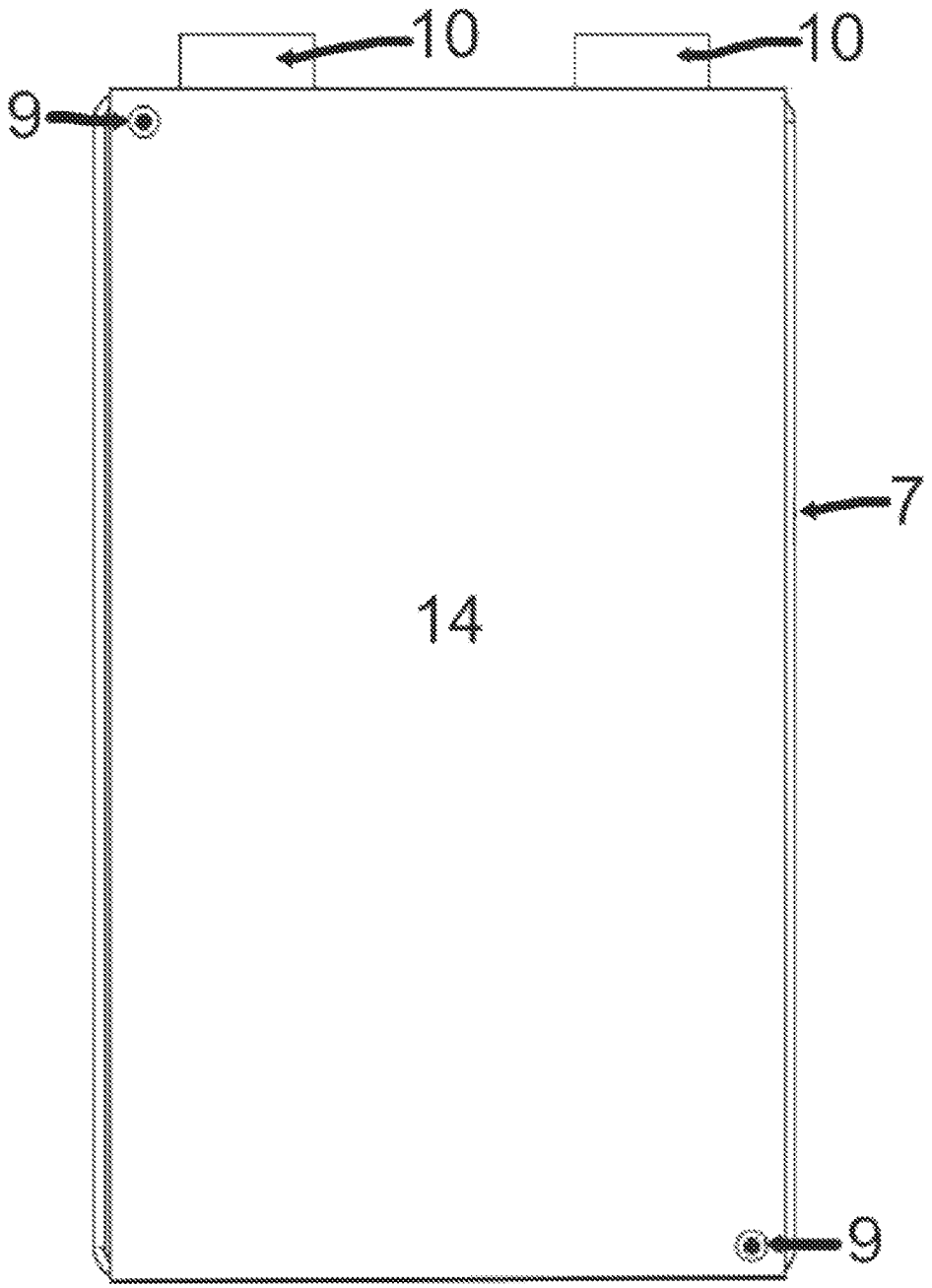
FIG. 1E is a supplementary schematic front orthographic view illustration of the thermal marine-thruster of FIG. 1.

FIG. 1E is a supplementary schematic front orthographic view illustration of the thermal marine-thruster of FIG. 1, wherein the electric heating-element 7, the electrically-insulative and thermally-conductive layer 14, and the electrically and thermally insulative layer 17 are joined together by the pair of rivets 9, and wherein the pair of external-terminals of the heating-element 7 are indicated by 10. Note that the electrically and thermally insulative layer 17 is hidden from view in the figure.

Figure 1F:
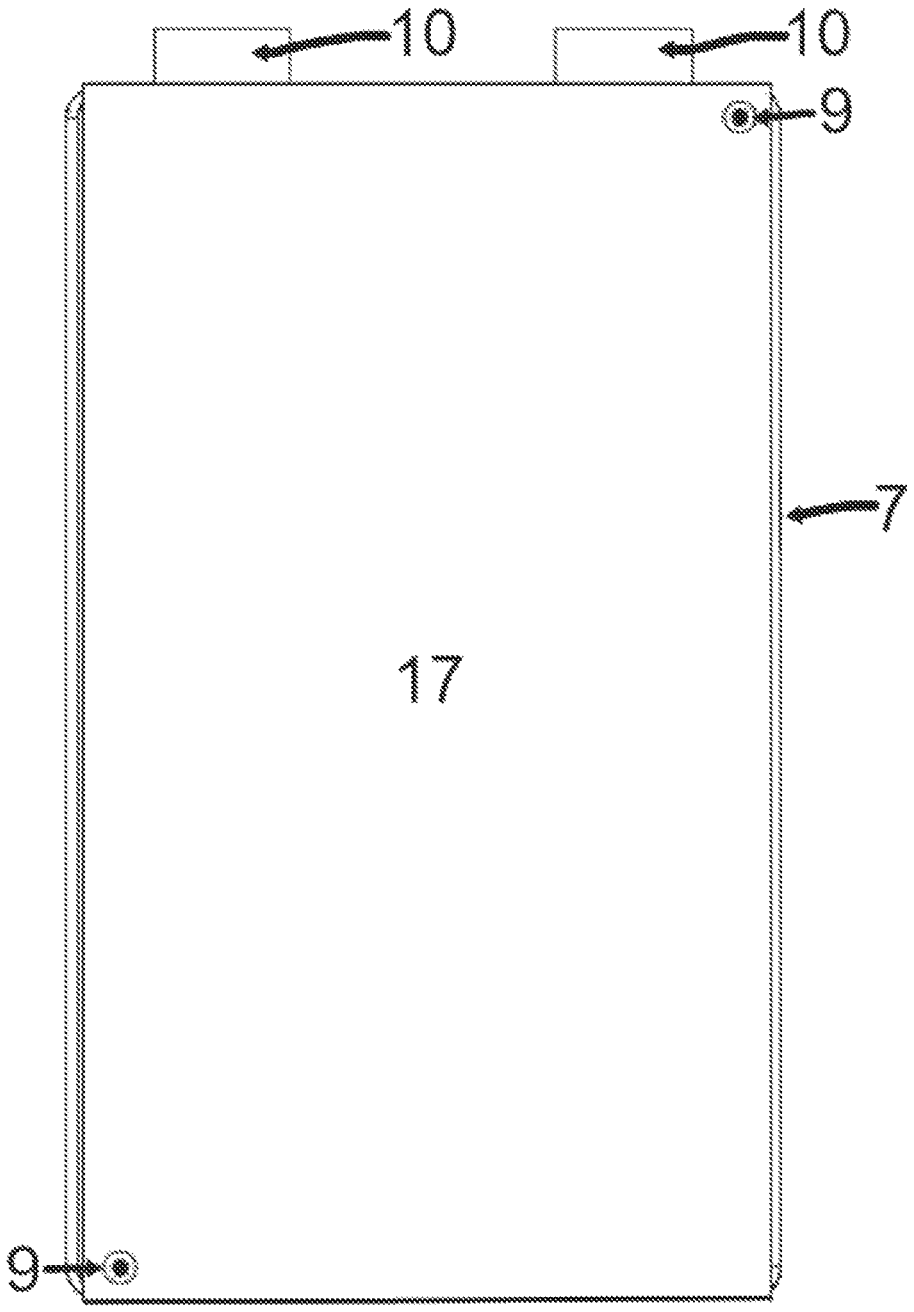
FIG. 1F is a supplementary schematic rear orthographic view illustration of the thermal marine-thruster of FIG. 1.

FIG. 1F is a supplementary schematic rear orthographic view illustration of the thermal marine-thruster of FIG. 1, wherein the electric heating-element 7, the electrically-insulative and thermally-conductive layer 14, and the electrically and thermally insulative layer 17 are joined together by the pair of rivets 9, and wherein the pair of external-terminals of the heating-element 7 are indicated by 10. Note that the electrically-insulative and thermally-conductive layer 14 is hidden from view in the figure.

Figure 2:
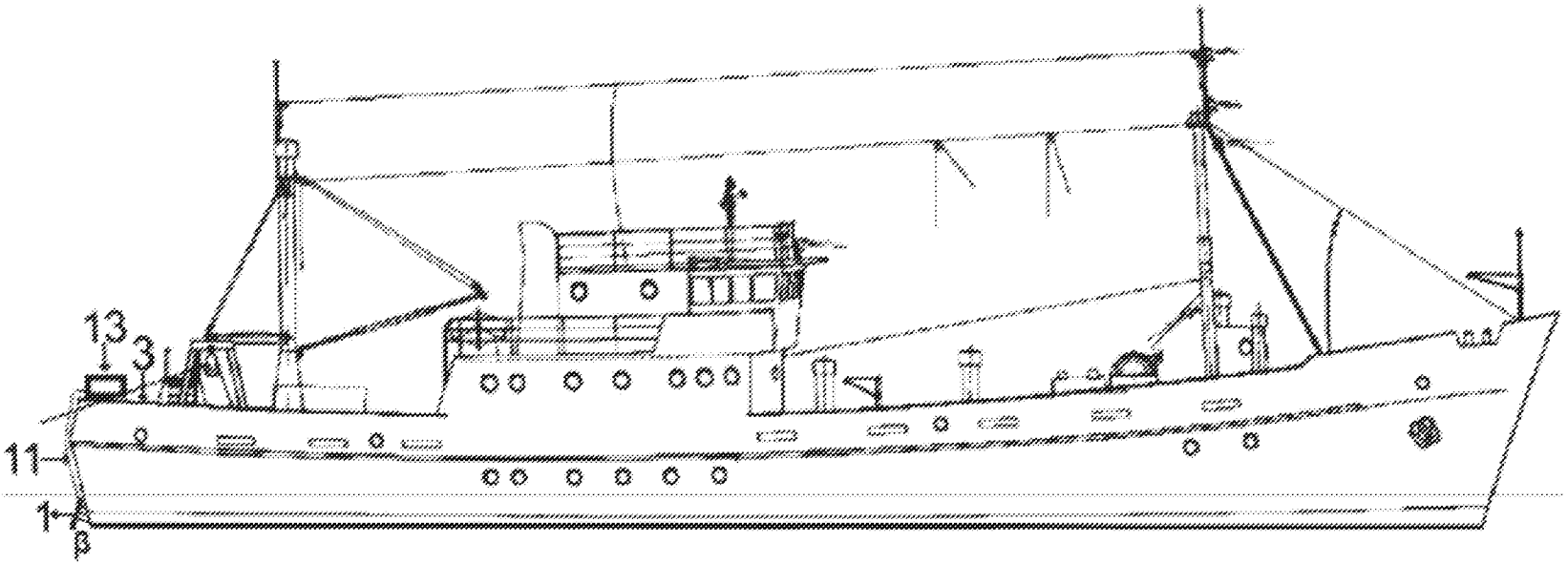
FIG. 2 is a schematic right-side orthographic view showing an illustrative and non-exclusive example of a watercraft, in a waterborne situation, installed with a solid-state thermal marine-thruster for a marine propulsion system according to the present invention.

Referring now to FIG. 2. a schematic right-side orthographic view illustration and non-exclusive example of a watercraft, in a waterborne situation, is shown, which is installed with a solid-state thermal marine-thruster for a marine propulsion system according to the present invention, wherein a thruster 1 is attached to the stern of the watercraft at an angle β via rivets 19 such that its hot-side, i.e. the outer-surface of the electrically-insulative and thermally-conductive layer 14, is facing outwards away from the stern so as to make contact with surrounding water, and wherein the thruster 1 is connected to the power-supply 13 via the pair of electrical-wires 11 and 12 at the pair of external-terminals 10, and the power-supply 13 is placed on the deck 3 of the watercraft. Note that the electrical-wire 12 is hidden from view behind the electrical-wire 11, and the rivets 19, the hot-side and the external-terminals 10 are also hidden from view but they are illustrated in subsequent figures for the sake of clarity and brevity.

Figure 2A:
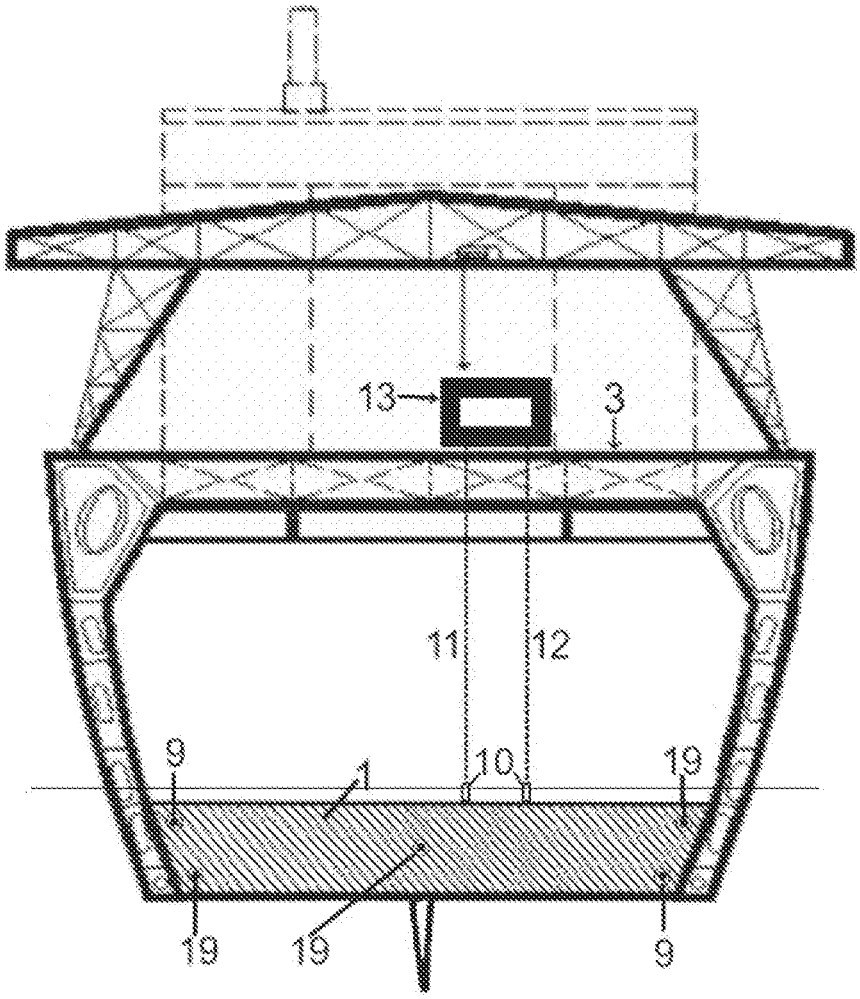
FIG. 2A is a supplementary schematic rear orthographic view of the watercraft of FIG. 2 showing the thermal marine propulsion system attached to the stern of the watercraft.

FIG. 2A is a supplementary schematic rear orthographic view of the watercraft of FIG. 2 showing the thermal marine propulsion system attached to the stern of the watercraft, wherein the thruster 1 is attached to the stern of the watercraft at an angle @ via the rivets 19 such that the hot-side (shaded in the figure) is facing outwards away from the stern so as to make contact with the surrounding water, and wherein the thruster 1 is connected to the power-supply 13 placed on the deck 3 via the pair of electrical-wires 11 and 12 at the pair of external-terminals 10. Note that the angle ß is hidden from view in the figure.

Figure 2B:
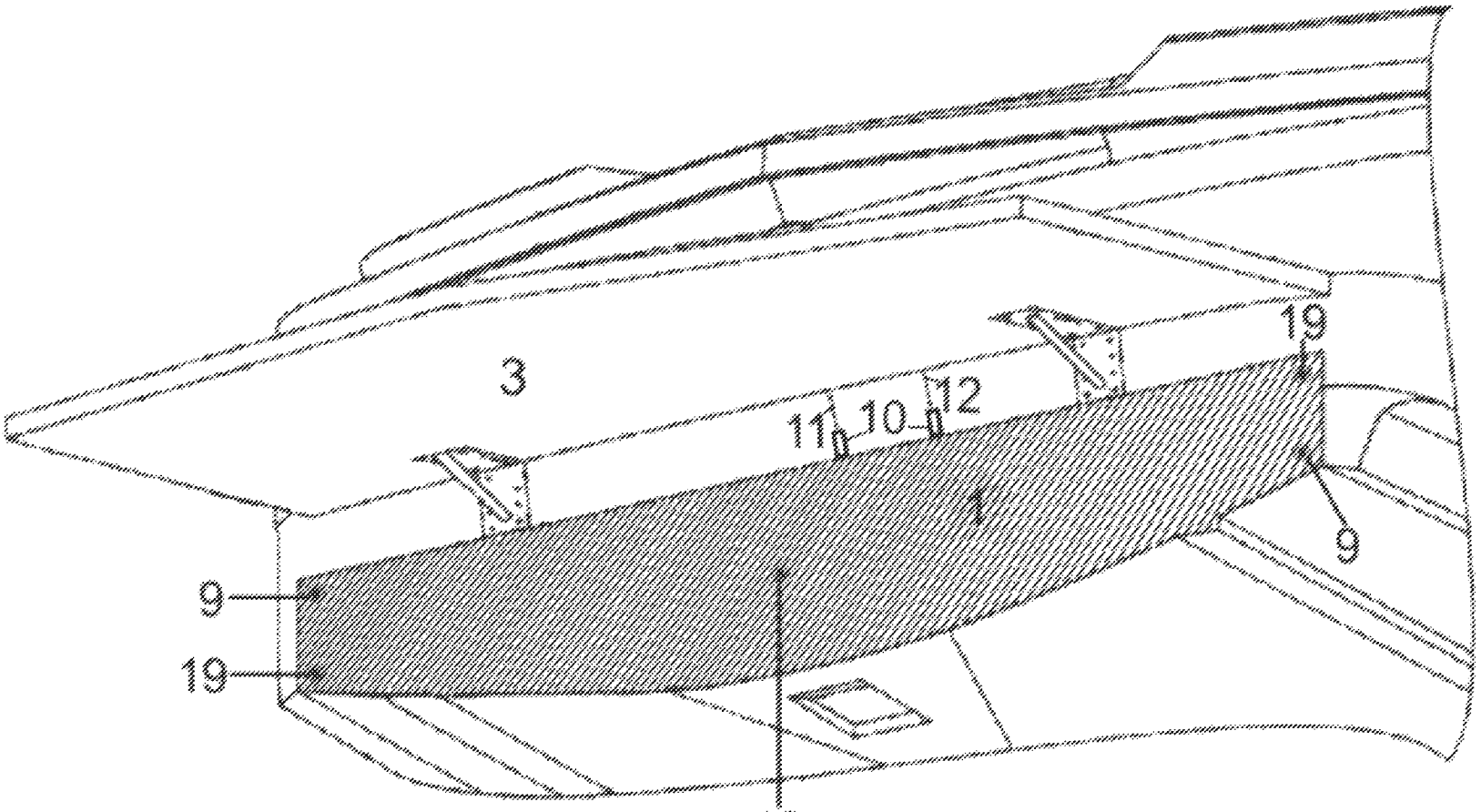
FIG. 2B is a supplementary schematic perspective detail view of the stern of the watercraft of FIG. 2 showing the attached thermal marine propulsion system.

FIG. 2B is a supplementary schematic perspective detail view of the stern of the watercraft of FIG. 2 showing the attached thermal marine propulsion system, wherein the thruster 1 is attached to the stern of the watercraft at an angle β via the rivets 19 such that the hot-side (shaded in the figure) is facing outwards away from the stern so as to make contact with the surrounding water, and wherein the thruster 1 is connected to the power-supply 13 via the pair of electrical-wires 11 and 12 at the pair of external-terminals 10. Note that the power-supply 13 is hidden from view in the figure due to being placed atop the deck 3, and the angle β is also hidden from view.

Consider a scenario wherein the heating-element of the thruster is activated in a submerged situation, thereby causing the hot-side to boil surrounding water and generate a steam-filled region around itself. At steady-state, the steam-filled region maintains a higher pressure than that of the water in which the thruster is submerged because as the water around the hot-side expands upon boiling, the resulting steam exerts a pressure on its surrounding water-filled region and the hot-side, and finally excess steam gets displaced in form of rising bubbles which creates a partial-vacuum for more water to rush in so as to perpetuate the entire process. Note that the pressure-difference between the steam-filled region surrounding the hot-side and the water surrounding the opposite outer-surface of the thruster exerts a thrust on the thruster along the (inward-pointing) normal-vector to the hot-side, wherein the thrust is proportional to the pressure-difference, which in turn, is proportional to the input-power from the power-supply to the heating-element. Note further that the steam-bubbles condense quickly upon contact with cooler surrounding water while rising, which prevents the formation of an undesired bubble-trail, as intended for military submarines.

Additionally, note that the thruster might be attached to the stern at an optimal angle β, that could be experimentally determined, so as to deflect the exhaust-fluid along the longitudinal direction of the watercraft and generate the maximum forward thrust, and the thruster might be configured to generate pulses of heat-energy so as to achieve an optimal trade-off between output thrust and energy-efficiency.

However, it's crucial to note that this simplified mechanism provides only a foundational understanding of the thruster's operation without considering the intricacies of all the thermodynamic processes inherent in the system, including but not limited to heat transfer, pressure distribution, fluid flow and energy conversion. A comprehensive understanding of the operation requires a more in-depth analysis of these factors.

Further, note that the presently invented thermal marine-thruster is effectively an external heat engine (EHE) in terms of operating mechanism, wherein the hot-steam inside the steam-filled region acts both as a thermodynamic working-fluid that transfers heat from the hot-side to the surrounding water-filled region and as a pneumatic working-fluid that pushes away the water-filled region as an exhaust-fluid, thereby imparting the thrust to the thruster.

Finally, recall that traditional marine-thrusters generate a thrust by the reaction of accelerating a mass of water by the action of rotating propellers or impellers and concept steam jet engines generate a thrust by the reaction of accelerating a mass of exhaust-gases (steam) out of a nozzle, whereas the presently invented thermal marine-thruster generates a thrust by the reaction of accelerating the surrounding water-filled region by the action of expanding steam. Hence, the presently invented thermal marine-thruster is more powerful and fuel-efficient than its traditional counterparts because its operation is based on the high expansion-ratio of water to steam phase-transition due to boiling which is absent in the latter, as desired for use in heavy-duty watercrafts such as aircraft carriers and military submarines, and cargo ships and cruise ships, respectively.

Figure 3:
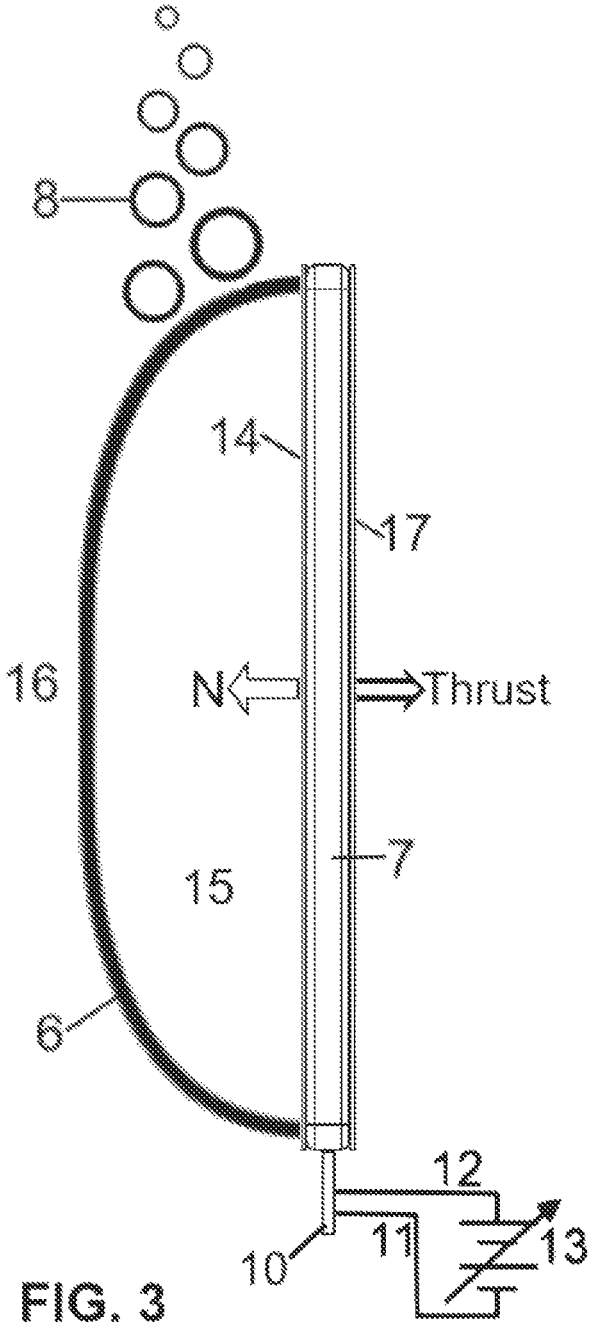
FIG. 3 schematically illustrates a side orthographic view of the steady-state of a steam-filled region formed around the hot-side of a solid-state thermal marine-thruster, in the active-state, for a marine propulsion system according to the present invention.

Referring finally to FIG. 3, a schematic illustration of a side orthographic view of the steady-state of a steam-filled region formed around the hot-side of a solid-state thermal marine-thruster, in the active-state, for a marine propulsion system according to the present invention is shown, wherein a steam-filled region 15 in the steady-state is effectively a bubble of hot-steam formed around the hot-side, i.e. the outer-surface of the electrically-insulative and thermally-conductive layer 14, of the thruster 1 when it's in the active-state, and wherein the heating-element 7 is connected to the power-supply 13 via the pair of electrical-wiring 11 and 12 at its external-terminals 10. Note that the hot-steam in the steam-filled region 15 continuously transfers heat from the hot-side to a surrounding water-filled region 16, and therefore boils water at the boundary 6 between the steam-filled region 15 and the surrounding water-filled region 16 so as to maintain a higher-pressure inside the former region than the latter, and finally excess steam escapes in the form of rising-bubbles 8 which quickly condense upon contact with cooler surrounding water without the formation of an undesired bubble-trail. The resultant pressure-difference between the hot-side and the opposite outer-surface of the electrically and thermally insulative layer 17 generates the desired thrust, as indicated by an arrow Thrust, along the (inward-pointing) normal-vector or equivalently opposite to the (outward-pointing) normal-vector, as indicated by an arrow N so as to avoid an overlap with the arrow Thrust for better clarity, to the hot-side.

Furthermore, the steam-filled region offers lesser drag to the watercraft than liquid water and the turbulence resulting from the rising steam has a self-cleaning effect on the thruster against biofouling.

Finally, note that the invention has been described in detail with particular respect to implementations thereof, but it will be appreciated that variations and modifications can be effected within the spirit and scope of the invention. For example, the plate-type electric heating-element may in particular be chosen from a variety of electric heating-elements including Resistance heating-element, PTC Ceramic heating-element, Capacitive heating-element, Thermoelectric heating-element, etc.; the electrically-insulative and thermally-conductive layer, and the electrically and thermally insulative ceramic layer may be attached to the heating-element by welding, adhesion, heat-shrinkage or mechanical fasteners (i.e., rivets, bolts and pins): and similarly, the thermal marine-thruster may be attached to the stern of the watercraft by welding, adhesion, heat-shrinkage or mechanical fasteners (i.e., rivets, bolts and pins). Further note that the thermal marine propulsion system of the present invention might be built into a watercraft or installed separately to an existing watercraft as an upgrade. Finally, while the invention is cast in the environment of watercrafts like ships and submarines, it has other uses, for example, in connection with aircrafts.

I claim:

1. A solid-state marine-thurster, characterized in that it comprises:

a plate-type electric heating-element having a heat-emitting surface so as to boil the surrounding water when in a submerged situation and form a high-pressure steam-filled region around the surface that translates into a thrust along the (inward-pointing) normal-vector to the surface;

wherein the heat-emitting surface is formed of a thermally-conductive and electrically-insulative layer, and the opposite-surface is formed of a thermally and electrically insulative layer; and wherein both the layers are mechanically attached to the heating-element, each layer covering the respective surface entirely.

2. The marine propulsion system of claim 1, further comprising a power-supply electrically connected to the heating-element.

* * * * *